US006547223B1

(12) United States Patent
Letourneau

(10) Patent No.: US 6,547,223 B1
(45) Date of Patent: Apr. 15, 2003

(54) RAIL STANCHION FOR CONCRETE SLAB WALLS

(76) Inventor: John Letourneau, 20951 Louie Crescent, Langley, British Columbia (CA), V3A 4P8

( * ) Notice: Subject to any disclaimer, the term of this patent is extended or adjusted under 35 U.S.C. 154(b) by 0 days.

(21) Appl. No.: 09/717,003

(22) Filed: Nov. 22, 2000

Related U.S. Application Data

(63) Continuation-in-part of application No. 09/153,884, filed on Sep. 16, 1998, now abandoned.
(60) Provisional application No. 60/059,269, filed on Sep. 18, 1997.

(30) Foreign Application Priority Data

Aug. 17, 1998 (CA) ..... 2245136

(51) Int. Cl.[7] ..... E04G 3/12; E04H 17/14
(52) U.S. Cl. ..... 265/65.02; 236/65.14; 236/47; 236/32; 403/362; 403/297
(58) Field of Search ..... 256/32, 33, 35, 256/65, 68, 47

(56) References Cited

U.S. PATENT DOCUMENTS

| | | | | | |
|---|---|---|---|---|---|
| 240,698 | A | * | 4/1881 | Giger | 256/35 |
| 347,713 | A | * | 8/1886 | Hume et al. | 256/35 |
| 595,600 | A | * | 12/1897 | Buck | 256/35 X |
| 697,259 | A | * | 4/1902 | Lavely | 256/32 |
| 700,074 | A | * | 5/1902 | Opel et al. | 256/35 |
| 1,068,206 | A | * | 7/1913 | Bennet | 256/35 |
| 2,734,727 | A | * | 2/1956 | Hensley | 256/48 |
| 2,833,522 | A | * | 5/1958 | Michaels | 256/65.13 |
| 3,274,744 | A | * | 9/1966 | Blum et al. | 256/65.16 |
| 3,351,324 | A | * | 11/1967 | Blum et al. | 256/68 |
| 4,134,575 | A | * | 1/1979 | Chavarria | 256/35 |
| 5,145,030 | A | * | 9/1992 | Pavlescak et al. | 182/113 |
| 5,154,256 | A | * | 10/1992 | Wood | 256/65 X |
| 5,573,227 | A | * | 11/1996 | Hemauer et al. | 256/65 |
| 5,586,423 | A | * | 12/1996 | Mullen | 256/65 X |
| 5,662,313 | A | * | 9/1997 | Forrester | 256/32 X |
| 6,015,138 | A | * | 1/2000 | Kohlberger et al. | 256/65 |
| 6,270,057 | B1 | * | 8/2001 | Highley et al. | 256/32 |

FOREIGN PATENT DOCUMENTS

| | | | | |
|---|---|---|---|---|
| SU | 1454943 A1 | * | 1/1989 | 256/65 |

* cited by examiner

*Primary Examiner*—Lynne H. Browne
*Assistant Examiner*—Ernesto Garcia
(74) *Attorney, Agent, or Firm*—Antony C. Edwards

(57) ABSTRACT

A railing mounting device for mounting railings to concrete slab walls includes a stanchion and an anchor insert. The stanchion is releasably mountable to the anchor insert. The stanchion is elongate and extends longitudinally between opposite first and second ends. The second end has a mounting member rigidly extending therefrom for sliding snug releasably securable mating engagement in a corresponding cavity in the anchor insert. The anchor insert is rigidly mountable into a concrete wall panel by flanges, fins or the like. The mounting member lies generally within a first plane containing the first and second ends. The first end is laterally offset in the first plane relative to the second end so as to extend over the mounting member in the first plane. Rail mounts are mountable to the stanchion towards the first end so as to mount rails to the stanchion offset relative to the second end.

19 Claims, 6 Drawing Sheets

RAIL STANCHION FOR CONCRETE SLAB WALLS

CROSS REFERENCE TO RELATED APPLICATION

This application is a Continuation-in-Part of application Ser. No. 09/153,884 filed Sep. 16, 1998, now abandoned which claims priority from U.S. Provisional Patent Application No. 60/059,269 filed Sep. 18, 1997 entitled Rail Stanchion for Concrete Slab Walls.

FIELD OF THE INVENTION

This invention relates to the field of safety handrails for the construction of buildings and in particular to stanchions for such handrails for releasable mounting to modular concrete slab walls.

BACKGROUND OF THE INVENTION

Judging by the plethora of prior art relating to safety rails which may be mounted onto building roofs, it would appear that there is a recurring safety problem of workers falling from the roofs of buildings which are under construction or which are having their roofs repaired or upon which other work is being performed. Obviously, these accidents occur when the workers are moving about, and it is believed, especially when the workers are carrying materials on the roof and are required to work near the edges of the roof.

As documented in the prior art, the magnitude of this workplace hazard has drawn the attention of regulatory bodies including the Occupational Safety and Health Administration in the United States, the Department of Occupational Safety and Health in Canada, and, as applicant is aware, the Workmen's Compensation Board in British Columbia, Canada. The prior art reports that in some, if not all jurisdictions, some form of barrier is now required around roof edges in the workplace.

Various attempts of which applicant is aware have been made in the prior art in the field generally of portable roof guard rail supports. Applicant is not, however, aware of any prior art specifically relating to the application of the present invention, that is, a removable mountable rail stanchion for use on modular concrete slab walls. However, in the general field, applicant is aware of U.S. Pat. Nos. 3,995,834 which issued Dec. 7, 1976, to Melfi for Supports for Guard Rails, and U.S. Pat. No. 4,669,577 which issued Jun. 2, 1987, to Werner for Slab Clamp Guard Rail Post. Both Melfi and Werner teach the mounting of guard rail stanchions onto a generally horizontal deck or like member by means of clamps. Neither teach nor suggest, nor are adaptable to provide the simplicity and usefulness of the stanchion of the present invention.

Applicant is also aware of U.S. Pat. No. 5,377,958 which issued Jan. 3, 1995, to Palmer for a Safety Railing System. Palmer discloses vertically extending stanchion members mounted to wall brackets by means of pivoting links. The pivoting links swing outwardly upon impact on the railing to distribute the load applied along a wall bracket. The wall bracket is mounted below the exterior facia of the wall by fasteners driven through the brackets into the underlying wall structure. Again, the simplicity and usefulness of the present invention in this application to concrete wall structures is neither taught nor suggested.

Applicant is also aware of prior art relating to safety rails mountable onto pitched roofs, two examples of which are U.S. Pat. No. 5,647,451 which issued Jul. 15, 1997, to Reichel for a Portable Roof Guard Rail Support Device, and U.S. Pat. No. 5,573,227 which issued Nov. 12, 1996, to Hemauer for a Guardrail Stanchion Mounted Onto Building Frame. As with the Palmer reference, both Reichel and Hemauer provide structures designed to distribute the load of a falling worker by various attachment means to the roof, facia, and underlying rafters.

Applicant is also aware of U.S. Pat. No. 4,003,541 which issued Jan. 18, 1977, to Lanier for a Portable Decking Form. Lanier teaches a decking form for the construction of modular housing units having a monolithic slab roof. As part of that teaching, Lanier makes use of vertical stanchions to support railings around the circumference of the roof, where the stanchions are slidably connected into channel bases secured to the roof I-beams. However, the advantages of the present invention relating to modular concrete slab walls are neither taught nor suggested.

Also taught for use on generally horizontal planar roofs is the Support for the Handrail of a Detachable Handrail Unit disclosed in U.S. Pat. No. 4,909,483 which issued Mar. 20, 1990, to van Herpen. The handrail supports of van Herpen include a base which is kept in place on the roof by use of a weight, and a post which is connected to the base, the base and the post interconnected by a horizontal hinge. A structure is provided for locking the base and post relative to each other so that the post is in a generally vertical handrail supporting position.

Applicant is further aware of Australian patent No.141, 378 which issued May 28, 1951, to Green for a Wire Fence Fastener; U.S. Pat. No. 4,015,827 which issued Apr. 5, 1977, to Brand for a Support Stanchion; U.S. Pat. No. 2,734,727 which issued Feb. 14, 1956 to Hensley for a Clean Row Fence Post; and U.S. Pat. No. 5,145,030 which issued Sep. 8, 1992 to Pavlescak et al for a Guard Rail Post.

Applicant notes that none of those references whether taken individually or collectively teach nor suggest a stanchion structure which, as described below allows a workman who is wearing a life line to walk along the uppermost surface of a concrete wall panel past stanchions supporting guardrails to which his life line is clipped.

SUMMARY OF THE INVENTION

In summary, the railing mounting device for mounting at least one flexible railing to concrete walls includes a stanchion. The stanchion may be releasably mountable to an anchor insert. The stanchion may be elongate and extend longitudinally between opposite first and second ends. The second end may have a mounting member mountable thereto so as to rigidly extend therefrom for sliding snug releasably securable mating engagement in a corresponding cavity in the anchor insert when the anchor insert is rigidly mounted into a concrete wall panel. The mounting member, when mounted to the stanchion, may lie generally in a first plane containing the first and second ends. The first end may be laterally offset in the first plane relative to the second end so as to extend over the mounting member in the first plane when mounted to the stanchion. A rail mount may be mountable to the stanchion towards the first end so as to releasably mount rails to the stanchion offset relative to the second end.

Without intending to be limiting, the rail mount may be at least one rigid substantially helical elongate member defining an eyelet along a longitudinal axis of a helix containing the helical elongate member. The longitudinal axis of the helix may be parallel to a flexible rail when the flexible rail is mounted into the eyelet. The eyelet may be sized so as to receive the flexible rail journalled therethrough. The helical elongate member may form a substantially helical loop. The helical elongate member may be rigidly mounted to the stanchion intermediately along the helical loop so that free ends of the helical loop extend away from the stanchion. The helical loop may be sized to allow passage of a life line clip ring sliding along the rail, firstly, so as to slide past a first free end of the free ends of the helical loop, secondly, so as to rotate the clip ring about the rail between the free ends of the helical loop so as to clear a second free end of the free ends of the helical loop, and thirdly, so as to slide past the second free end thereby passing the clip ring along the rail through the helical loop without unclipping the clip ring from the rail.

The at least one rigid helical elongate member may be a pair of helical elongate members spaced apart along a first portion of the stanchion extending between the first end and a laterally offsetting portion in the stanchion wherein the off-setting portion leg may laterally offset the first end from the second end.

Without intending to be limiting, in an alternative embodiment the rail mount may be at least one channel in the stanchion cooperating with a rail supporting bore in the stanchion, wherein the channel may be formed in the stanchion so as to be angularly offset, when the stanchion is mounted to the concrete wall, relative to a longitudinal axis of the flexible railing when the railing extends parallel to an upper edge of the concrete wall. The channel may be formed across the stanchion. The bore may be formed through the stanchion so as to intersect with the channel along its length. The at least one channel may include a channel formed diagonally in an uppermost surface of the first end. The bore may be substantially cylindrical. The channel may define substantially a parallelepiped. A lip may form at least one point of intersection between the channel and the bore for retaining the railing in the bore.

The anchor insert may be a tube mountable into a concrete slab wall. The mounting member may be a rigid cantilevered insert for snug sliding fitment into the tube. The cantilevered insert may be mounted to, so as to extend generally perpendicularly from, the second end of the stanchion without intending to be limiting, the tube may be a polygon in lateral cross-section therethrough and the cantilevered insert is correspondingly shaped in lateral cross-section, although it is intended to be within the scope of the invention that the stanchion be bolted to the concrete wall, the bolts engaging threaded inserts in the concrete. The offsetting portion may be positioned generally half-way along the stanchion. The first portion and second portion extend between the second end and the offsetting portion may be generally linear and parallel and have a first length and a second length respectively, and wherein the offsetting portion may have an elongate portion, angularly offset relative to the first and second portions.

In these alternative embodiments, not intended to be limiting, the elongate portion of the offsetting portion may extend a length not exceeding the length of either the first portion or the second portion, or may extend a length exceeding the length of either the first portion or the second portion, or may extend a length equal to the length of either the first portion or the second portion.

DETAILED DESCRIPTION OF PREFERRED EMBODIMENTS

Figure 1:
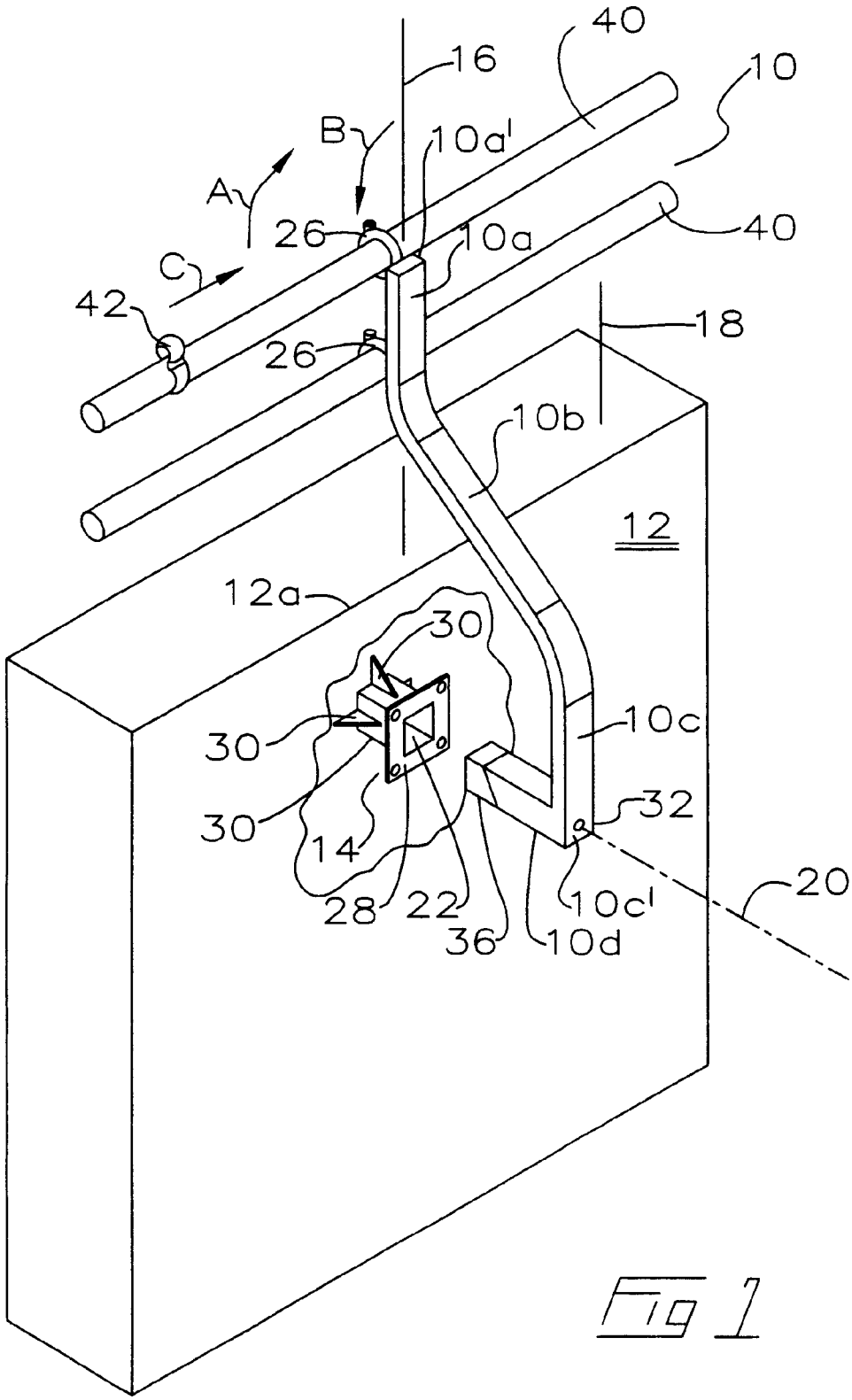
FIG. 1 is, in perspective view, the stanchion and stanchion support of the present invention illustrated in partial cutaway exploded view mounted within a concrete slab wall.
Figure 2:
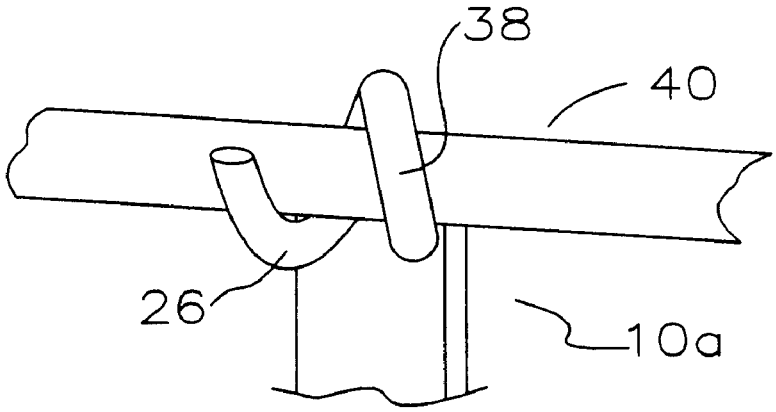
FIG. 2 is, in segmented perspective view, the stanchion of the present invention.
Figure 2:
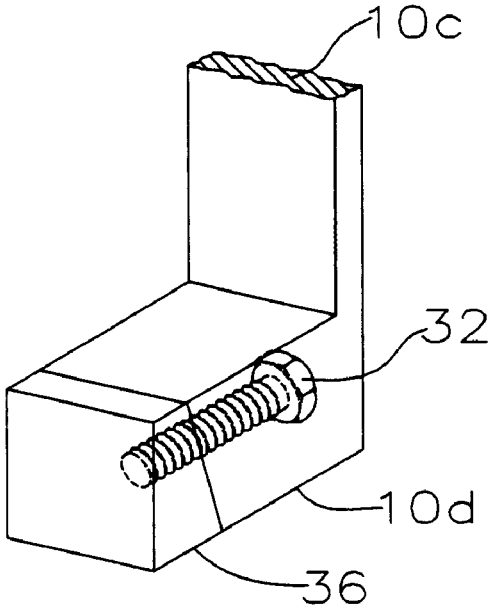
Figure 3:
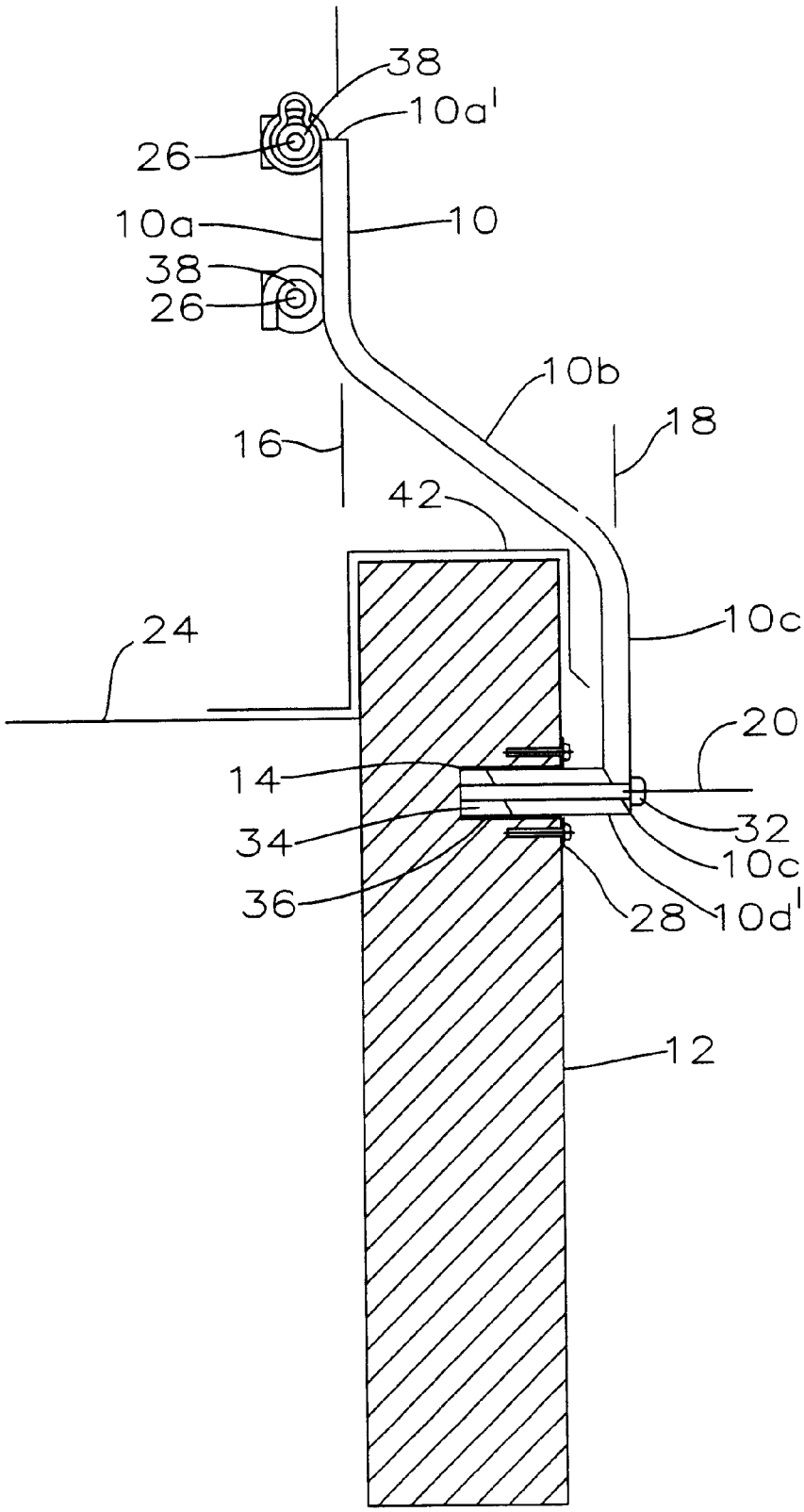
FIG. 3 is, in side elevation cross-sectional view, the stanchion of FIGS. 1 and 2 mounted into a concrete wall.
Figure 5:
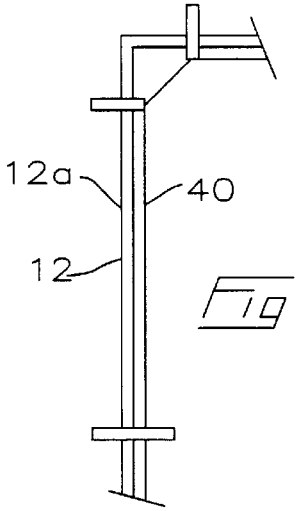
FIG. 5 is an enlarged view of a portion of FIG. 4.
Figure 4:
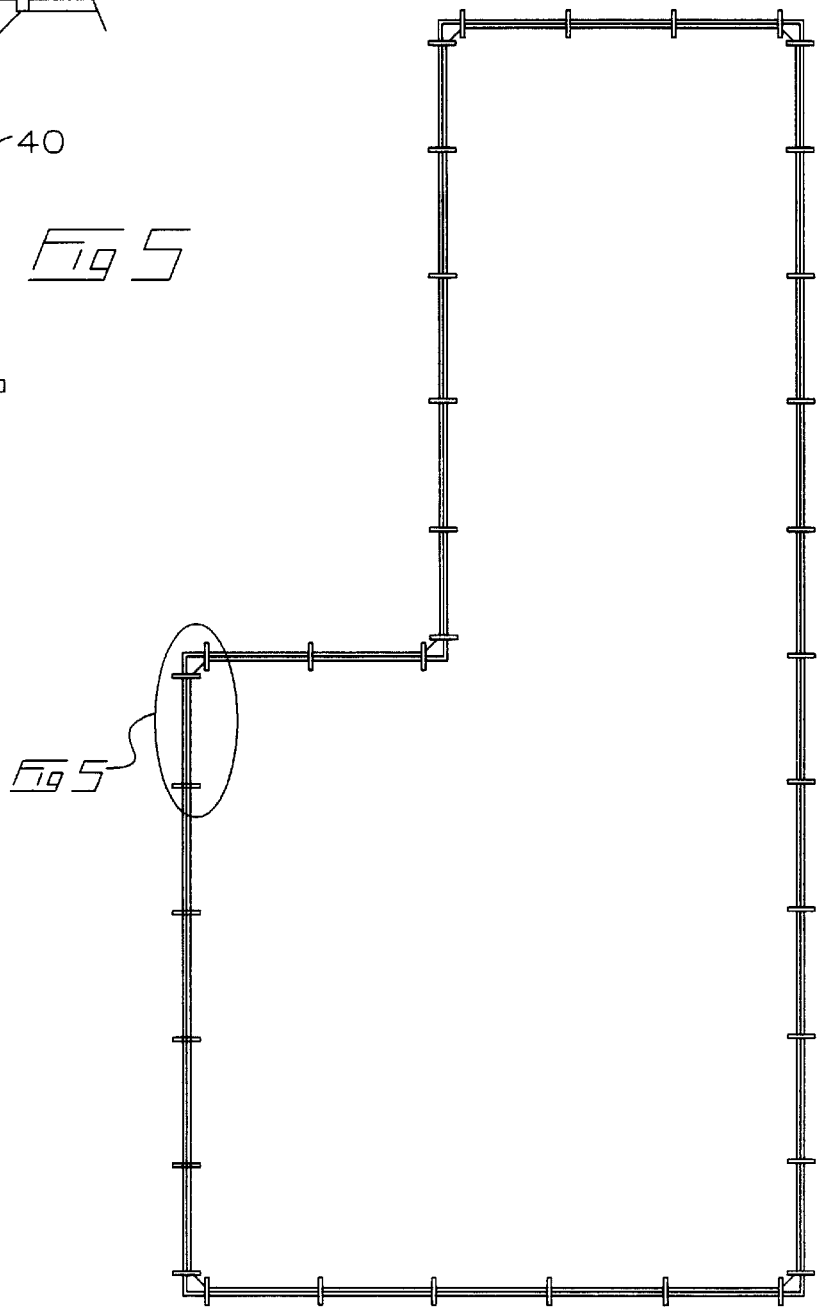
FIG. 4 is, in plan view, a roof having the stanchions of the present invention mounted thereon.
Figure 6:
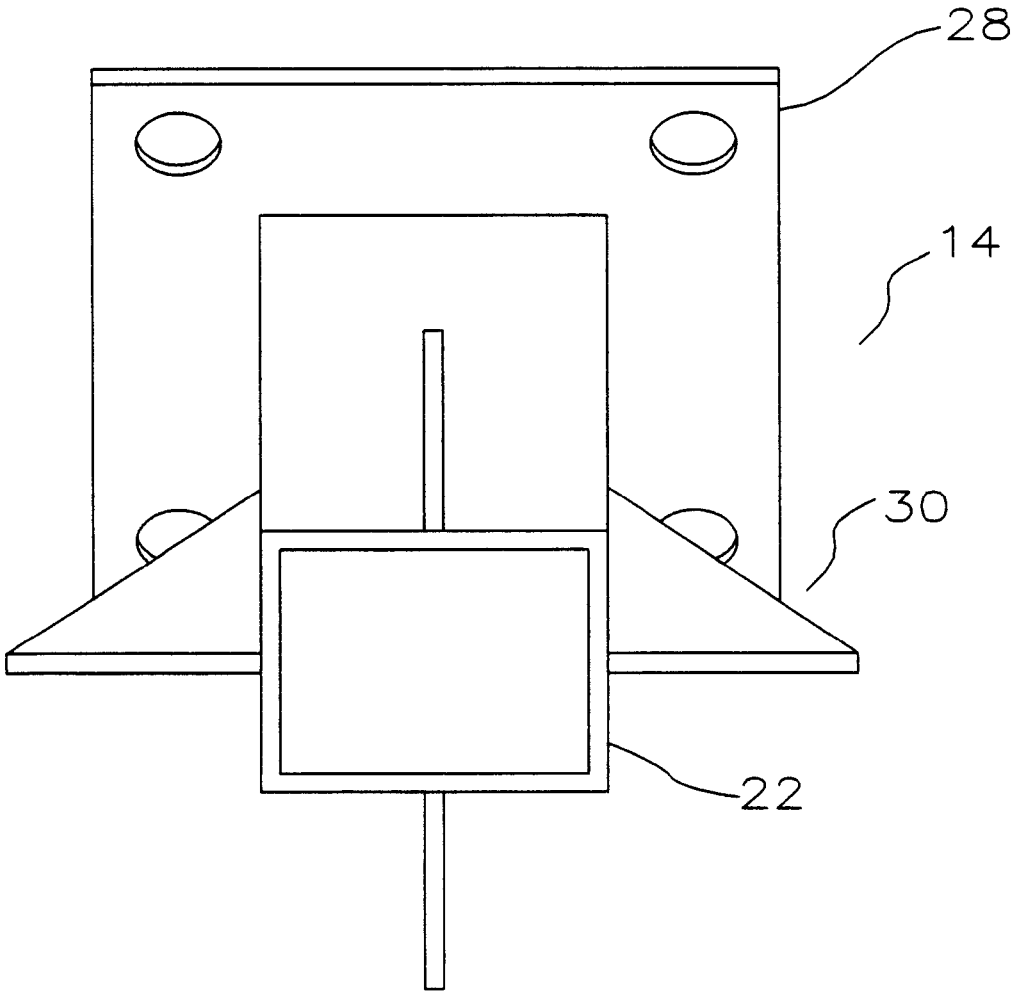
FIG. 6 is, in perspective view, an anchor insert of the stanchion support system of the present invention.

As seen in FIGS. 1–3, stanchion 10 is releasably mountable into concrete wall panel 12 by means of anchor insert 14. Stanchion 10 has, starting at upper end 10*a'*, an upper generally vertical elongate portion 10*a*, a curved middle portion 10*b* and a lower generally vertical elongate portion 10*c* rigidly mounted at lower end 10*c'* to a generally horizontal elongate mounting member 10*d*. Upper end 10*a'* is also referred to herein as the first end of the stanchion. Lower end 10*c'* is also referred to herein as the second end of the stanchion. As may be seen, ends 10*a'* and 10*c'* form opposite ends of stanchion 10. Curved middle portion 10*b* connects upper portion 10*a* to lower portion 10*c* in a lazy or flattened "S" curve or dogs-leg so as to offset longitudinal axes 16 and 18 corresponding to upper portion 10*a* and lower portion 10*c* respectively so as to maintain axes 16 and 18 generally parallel. Longitudinal axis 20 corresponding to mounting member 10*d* is generally perpendicular to longitudinal axes 16 and 18 and generally lies in a plane, also referred to herein as the first plane, defined by longitudinal axes 16 and 18. Thus, as may be seen most clearly in FIGS. 1 and 3, ends 10*a'* (the fit end) and 10*c*' (the second end) of stanchion 10 lie in the first plane defined by the parallel axes 16 and 18, and mounting member 10*d* also lies in that plane as its longitudinal axis 20 is perpendicular to both axes 16 and 18. In an alternative embodiment, lower portion 10*c* may be bolted to wall panel 12, for example so as to engage bolts (not shown) journalled through holes in lower portion 10*c* with threaded inserts mounted in the wall panel.

Lower portion 10*c* may be approximately 12 inches long so that when mounting member 10*d* is releasably journalled in snug sliding engagement within elongate hollow sleeve 22 in anchor insert 14, and anchor insert 14 is formed into concrete wall panel 12 so as to approximately displaced 12 inches downwardly from an uppermost edge 12*a* of concrete wall panel 12, middle portion 10*b* offsets upper portion 10*a* inwardly over roof 24 by reason of the aforementioned lateral offset. When stanchion 10 is mounted into anchor insert 14, stanchion 10 may extend generally vertically upwards approximately 32 feet above roof 24 so as to support in vertically spaced apart relation rail mounts 26 rigidly mounted to upper portion 10*a*.

Anchor insert 14 is rigidly anchored into concrete wall panel 12, for example, by bolts through apertured face plate 28, or by, or in conjunction with, anchoring fins 30 rigidly mounted so as to radially extend from sleeve 22. Mounting member 10*d* is releasably secured within sleeve 22 by means of through bolt 32 rotatably journalled within mounting member 10*d* along axis 20 so as to threadably engage threaded end plate 34 on wedge section 36. Thus tightening through bolt 32 slides wedge section 36 laterally relative to mounting member 10*d* and axis 20 so as to frictionally engage the inner walls of sleeve 22.

Rail mounts 26 may be formed by a rigid helical member so that once rigidly mounted as by welding to stanchion 10, an aperture or eyelet 38 is provided so as to receive therethrough cable or wire rope rails 40. The use of a helical curved member as rail mount 26, allows a workman tethered to a rail 40 by means of, for example, clip ring 42 to translate his life line and clip ring 42 along rails 40 past stanchions 10 without having to unclip clip ring 42 from rail 40 and then reclip the clip ring on the opposite side of rail mount 26. This is accomplished by sliding clip ring 42 along rail 40 until it engages rail mount 26 and then rotating clip ring 42 upwardly in direction A and continuing to slide clip ring 42 along rail 40 until the first portion of rail mount 26 is cleared and then lowering clip ring 42 in direction B so as to then clear the opposite portion of rail mount 26 as clip ring 42 is continued to translate in direction C along rail 40.

Because upper portion 10*a* is inwardly laterally offset relative to lower portion 10*c* on stanchion 10, a workman may walk along the uppermost surface of concrete wall panel 12. One advantage of the system of the present invention is clear in that concrete wall panels 12 may be formed, as is presently the custom, as a planar horizontal panel and once so formed and positioned, then tilted upwardly into position to form a wall section. Thus the placement of anchor inserts 14, or the anchor inserts for the bolts if lower portion 10*c* is merely to be bolted on, may be easily accomplished during the forming of the wall panel 12 so that anchor insert 14 or the bolts through lower portion 10*c* will be ready for use once the concrete wall panel 12 is tilted up into position.

Mounting member 10*d* may be sized so as to protrude sufficiently from anchor insert 14 when journalled therein so that lower member 10*c* clears without interfering with roofing, flashing or facia 42 installed over edge 12*a* of concrete wall panel 12.

Figure 7:
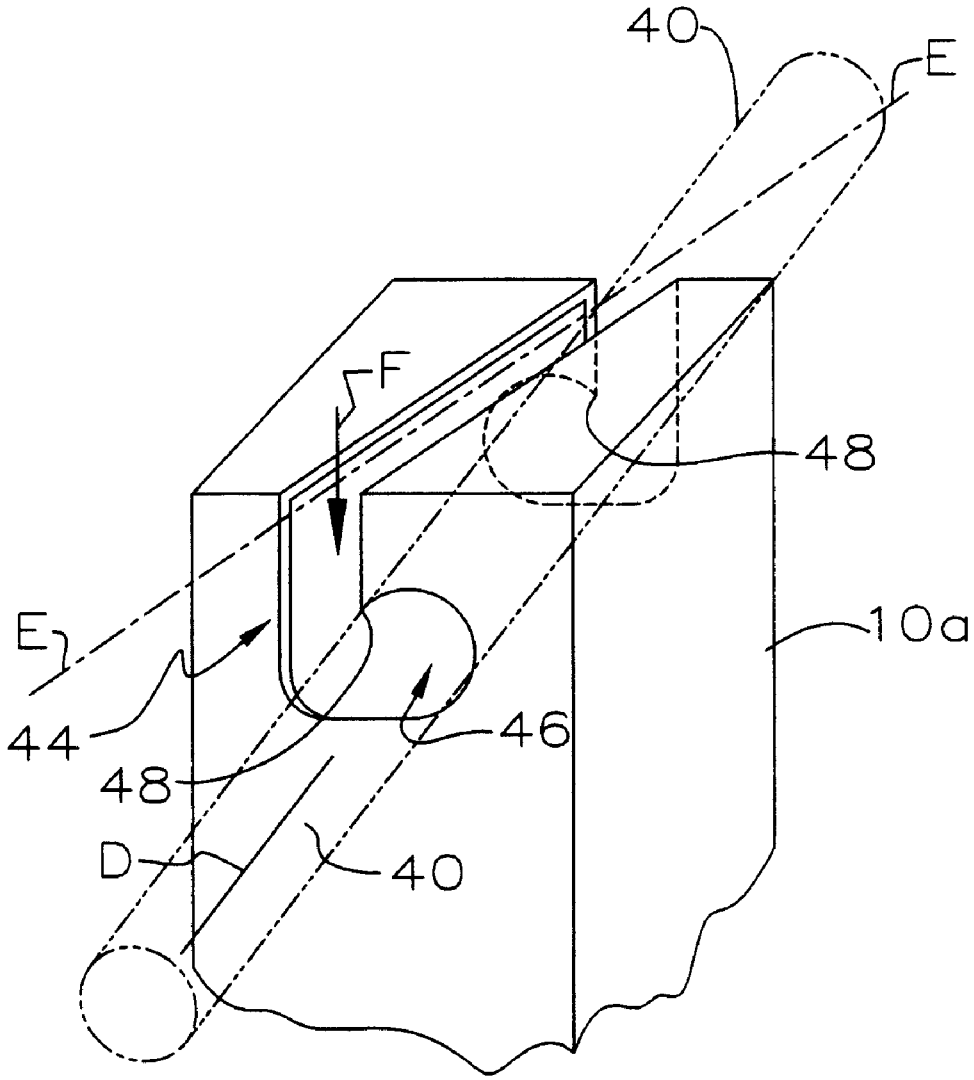
FIG. 7 is, in perspective view, an alternative embodiment of the upper end of the stanchion of the present invention.

In a further alternative embodiment, instead of using rail mounts 26 formed of rigid helical members, rail 40 may be releasably mounted to upper portion 10*a* of stanchion 10 by a channel 44 as seen in FIG. 7. Channel 44 may be cut or formed in the uppermost end of upper portion 10*a* angularly offset relative to the longitudinal axis D of rail 40 (seen in clotted outline in FIG. 7). An example of one angular relation of channel 44 to axis D is illustrated in FIG. 7 by diagonal axis E. Axis E lies in the plane, in this example vertical, bisecting channel 44.

Channel 44 is wide enough so that, when rail 40 is deflected along a portion of the rail so as to align that portion parallel with axis E, that portion of the rail may then be slid through channel 44. In this manner, rail 40 may be either installed or removed from within bore 46, where bore 46 may be parallel to, and concentric about, axis D. Thus when mounted in bore 46, rail 40 is relaxed from the distortion or deflection imparted to it in order to pass the rail through channel 44. Bore 46 communicates and cooperates with channel 44 along the open intersection between the two so that once rail 40 has, for example, been pressed down in direction F so as to slide down through channel 44, rail 40 will snap into bore 46 under its inherent return biasing force due to the tension in rail 40 urging the rail to straighten.

At the outer edges of the intersection between channel 44 and bore 46, oppositely disposed lips 48 may be formed if the channel is planar and the bore cylindrical. Lips 48 assist in holding rail 40 within bore 46 until a user wishes to deliberately remove the rail from the bore.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A railing mounting device for mounting at least one flexible railing to a concrete wall panel having a thickness, comprising a stanchion and an anchor insert adapted for mounting into a concrete wall panel wherein said stanchion is releasably mountable to said anchor insert, wherein said stanchion is elongate and extends longitudinally between opposite first and second ends, said second end have a mounting member mounted thereto so as to rigidly extend therefrom for sliding snug releasably securable mating engagement in a corresponding cavity in said anchor insert when the anchor insert is rigidly mounted into the concrete wall panel, said mounting member lying generally in a first plane containing said first and second ends, said first end laterally offset by substantially the thickness of the concrete wall panel in said first plane relative to said second end so as to extend over said mounting member in said first plane, said stanchion having a rail mount towards said first end so as to releasably mount rails to said stanchion offset relative to said second end over the concrete wall panel when mounted thereto.

2. The railing mounting device of claim 1 wherein said rail mount is at least one rigid substantially helical elongate member defining an eyelet along a longitudinal axis of a helix containing said helical elongate member, said longitudinal axis of said helix parallel to a flexible rail when said flexible rail is mounted into said eyelet, said eyelet sized so as to receive said flexible rail journalled therethrough, said helical elongate member forming a substantially helical loop, said helical elongate member rigidly mounted to said stanchion intermediately along said helical loop so that free ends of said helical loop extend away from said stanchion, said helical loop sized to allow passage of a life line clip ring sliding along said rail, firstly, so as to slide past a first free end of said free ends of said helical loop, secondly, so as to rotate said clip ring about said rail between said free ends of said helical loop so as to clear a second free end of said free ends of said helical loop, and thirdly, so as to slide past said second free end thereby passing said clip ring along said rail through said helical loop without unclipping said clip ring from said rail.

3. The railing mounting device of claim 2 wherein said at least one rigid helical elongate member is a pair of helical elongate members spaced apart along a first portion of said stanchion extending between said first end and a laterally offsetting portion in said stanchion wherein said off-setting portion leg laterally offsets said first end from said second end.

4. The railing mounting device of claim 3 wherein said anchor insert is a tube mountable into a concrete slab wall, and wherein said mounting member is a rigid cantilevered insert for snug sliding fitment into said tube.

5. The railing mounting device of claim 4 wherein said cantilevered insert is mounted to, so as to extend generally perpendicularly from, said second end of said stanchion.

6. The railing mounting device of claim 5 wherein said tube is a polygon in lateral cross-section therethrough and said cantilevered insert is correspondingly shaped in lateral cross-section.

7. The railing mounting device of claim 6 wherein said polygon is a regular polygon.

8. The railing mounting device of claim 7 wherein said regular polygon is a square.

9. The railing mounting device of claim 3 wherein said offsetting portion is positioned generally half-way along said stanchion.

10. The railing mounting device of claim 3 wherein said first portion and second portion extending between said second end and said offsetting portion are generally linear and parallel and have a first length and a second length respectively and wherein said offsetting portion has an elongate portion, angularly offset relative to said first and second portions.

11. The railing mounting device of claim 10 wherein said elongate portion of said offsetting portion extends a length not exceeding the length of either said first portion or said second portion.

12. The railing mounting device of claim 10 wherein said elongate portion of said offsetting portion extends a length exceeding the length of either said first portion or said second portion.

13. The railing mounting device of claim 10 wherein said elongate portion of said offsetting portion extends a length equal to the length of either said first portion or said second portion.

14. The rail mounting device of claim 1 wherein said rail mount is at least one channel in said stanchion cooperating with a rail supporting bore in said stanchion, said channel formed in said stanchion is angularly offset, when said stanchion is mounted to said concrete wall, relative to a longitudinal axis of said flexible railing when said railing extends parallel to an upper edge of said concrete wall, said channel formed across said stanchion, said bore formed through said stanchion and intersecting said channel along its length.

15. The rail mounting device of claim 14 wherein said at least one channel is a channel formed diagonally in an uppermost surface of said first end.

16. The rail mounting device of claim 14 wherein said bore is substantially cylindrical.

17. The rail mounting device of claim 16 wherein said channel defines substantially a parallelepiped.

18. The rail mounting device of claim 14 wherein a lip is formed at least one point of intersection between said channel and said bore for retaining said railing in said bore.

19. The rail mounting device of claim 17 wherein a lip is formed at least one point of intersection between said channel and said bore for retaining said railing in said bore.

* * * * *